US009363873B2

(12) United States Patent
Van Eerden et al.

(10) Patent No.: US 9,363,873 B2
(45) Date of Patent: Jun. 7, 2016

(54) POWER CIRCUIT FOR A GAS DISCHARGE LAMP

(75) Inventors: Gerrit Hendrik Van Eerden, Aalten (NL); Patrick Alexander Maria Boink, Haaksbergen (NL)

(73) Assignee: N.V. NEDERLANDSCHE APPARATENFABRIEK NEDAP, Groenlo (NL)

( * ) Notice: Subject to any disclaimer, the term of this patent is extended or adjusted under 35 U.S.C. 154(b) by 0 days.

(21) Appl. No.: 14/342,630

(22) PCT Filed: Sep. 3, 2012

(86) PCT No.: PCT/NL2012/050606

§ 371 (c)(1),
(2), (4) Date: Jun. 3, 2014

(87) PCT Pub. No.: WO2013/032337

PCT Pub. Date: Mar. 7, 2013

(65) Prior Publication Data

US 2014/0292199 A1 Oct. 2, 2014

(30) Foreign Application Priority Data

Sep. 2, 2011 (NL) ..... 2007337

(51) Int. Cl.

| | |
|---|---|
| ***H05B 41/18*** | (2006.01) |
| ***H05B 41/298*** | (2006.01) |
| ***H05B 41/392*** | (2006.01) |
| ***H05B 41/38*** | (2006.01) |

(52) U.S. Cl.

CPC ..... *H05B 41/2988* (2013.01); *H05B 41/298* (2013.01); *H05B 41/2985* (2013.01); *H05B 41/38* (2013.01); *H05B 41/3921* (2013.01)

(58) Field of Classification Search

None

See application file for complete search history.

(56) References Cited

U.S. PATENT DOCUMENTS

| | | | | |
|---|---|---|---|---|
| 5,719,471 | A * | 2/1998 | Kachmarik | 315/209 R |
| 2004/0113102 | A1 | 6/2004 | Wedekamp | |
| 2005/0067973 | A1 * | 3/2005 | Beij et al. | 315/209 R |
| 2006/0006813 | A1 * | 1/2006 | Van Casteren | 315/274 |
| 2009/0273299 | A1 | 11/2009 | Gawrys et al. | |
| 2011/0062879 | A1 * | 3/2011 | Yadlapalli et al. | 315/250 |

FOREIGN PATENT DOCUMENTS

| | | | |
|---|---|---|---|
| DE | 10112115 | A1 | 10/2002 |
| EP | 0707438 | A2 | 4/1996 |
| EP | 1675442 | A2 | 6/2006 |
| WO | 00/71227 | A1 | 11/2000 |
| WO | 01/89271 | A1 | 11/2001 |
| WO | 02/076153 | A1 | 9/2002 |
| WO | WO 2010109389 | A1 * | 9/2010 |

* cited by examiner

*Primary Examiner* — Douglas W Owens
*Assistant Examiner* — Dedei K Hammond
(74) *Attorney, Agent, or Firm* — Jacobson Holman, PLLC.

(57) ABSTRACT

A power circuit for at least one gas discharge lamp comprising a first filament and a second filament, the power circuit including an electronic driver circuit, preferably for generating a first alternating voltage between the first and second filament for starting up the gas discharge lamp and for generating a second alternating voltage between the first and second filament for having the gas discharge lamp burn after it has been started up, wherein the power circuit further includes an electronic heating circuit for, at least during generation of the second alternating voltage, generating a first current through the first filament for heating the first filament and/or generating a second current through the second filament for heating the second filament.

28 Claims, 9 Drawing Sheets

POWER CIRCUIT FOR A GAS DISCHARGE LAMP

This is a national stage of PCT/NL12/050606 filed Sep. 3, 2012 and published in English, which has a priority of The Netherlands no. 2007337 filed Sep. 2, 2011, hereby incorporated by reference.

The invention relates to a power circuit for at least one gas discharge lamp comprising a first filament and a second filament, the power circuit including an electronic driver circuit, preferably for generating a first alternating voltage between the first and second filament for starting up the gas discharge lamp and for generating a second alternating voltage between the first and second filament for having the gas discharge lamp burn after it has been started up. It is noted that a filament of a gas discharge lamp is sometimes referred to as an incandescent filament of a gas discharge lamp.

The invention also relates to a system including a power circuit and at least one gas discharge lamp which is connected to the power circuit. Further, the invention relates to such a system that is configured for disinfecting water with UV light and for this purpose further includes a watertight housing in which the lamp is contained.

Such power circuits and systems are known per se. In particular, it is known with such power circuits to control a low pressure gas discharge lamp for generating ultraviolet light. This ultraviolet light is then used in particular in disinfecting waste water and drinking water. Low-pressure gas discharge lamps then provide an advantage owing to their higher efficiency in comparison with medium- and high-pressure lamps. Work is being done on a new generation of low-pressure amalgam lamps up to a power of 1,000 watts, where the total efficiency of a system, and hence the energy consumption, is becoming increasingly important.

A problem with a low-pressure gas discharge lamp for generating ultraviolet light is that the light emission and hence the efficiency of the lamp depends on the amalgam temperature, this amalgam temperature in turn depending on the temperature of the water in which the lamp is received for disinfecting the water. More generally, it is a problem with any type of system including a gas discharge lamp that in gas discharge lamps the temperature of the lamp may deviate from the optimum value, more particularly, becomes too low under the influence of its environment, with the result that the efficiency of the lamp decreases.

The invention contemplates, for one thing, providing a solution to this problem. To this end, the power circuit according to the invention is characterized in that the power circuit further includes an electronic heating circuit for, at least during generation of the second alternating voltage, generating a first current through the first filament for heating the first filament and/or generating a second current through the second filament for heating the second filament. According to the invention, the first filament and/or the second filament are therefore used also as a possible heat source for the gas discharge lamp. For heating up the lamp, the electronic heating circuit can send a first current through the first filament and/or send a second current through the second filament. The first current and the second current can, as regards the heating, be a supplementation to the current flowing between the first filament and the second filament as a result of the first alternating voltage and/or second alternating voltage. In particular, it holds here that the power circuit includes a control circuit for controlling the driver circuit and/or the heating circuit. In particular, it holds here that the control circuit is configured for regulating the magnitude of the first current and/or the magnitude of the second current in dependence upon the magnitude of the lamp current that runs between the first filament and the second filament as a result of the second alternating voltage. More particularly, it holds here that the control circuit is configured to increase the magnitude of the first current and/or the magnitude of the second current if the lamp current decreases and vice versa. Now, if, for example, the temperature of the gas present in the gas discharge lamp decreases, the lamp current and hence the efficiency of the lamp will also decrease. This is detected by the control circuit. In response, the control circuit will increase the magnitude of the first current and/or the magnitude of the second current. This in turn has as a result that the first filament and/or the second filament are heated extra, so that the temperature of the gas in the lamp will increase again. It may then be so that when the lamp current exceeds a predetermined value, the magnitude of the first current and/or the magnitude of the second current becomes equal to zero. If the lamp current has a magnitude that is equal to the predetermined value, the lamp current is set optimally for the desired efficiency. The regulation may then be such that when the magnitude of the lamp current becomes smaller than the predetermined value, the magnitude of the first current and/or the magnitude of the second current is set from zero to a fixed value which is greater than zero. This has as an effect that the lamp is heated extra until the lamp current becomes greater than the predetermined value again. Of course, it is also possible, however, that when the magnitude of the lamp current becomes smaller than the predetermined value, the magnitude of the first current becomes greater than zero and thereupon increases when the lamp current decreases further. The same applies also to the magnitude of the second current. If in such a case the lamp current increases again, the magnitude of the first current and/or the magnitude of the second current will decrease again and become equal to zero when the magnitude of the lamp current becomes greater than the predetermined value again. Such possibilities of regulating the magnitude of the first current and/or the magnitude of the second current each fall within the framework of the invention. In particular, the control circuit is configured for, when the magnitude of the lamp current is within a predetermined interval, increasing the magnitude of the first current and/or the magnitude of the second current if the lamp current decreases and vice versa, while, in particular, the magnitude of the first current and the magnitude of the second current becomes zero when the lamp current becomes greater than a predetermined value.

More particularly, it holds that the driver circuit is configured to enable dimming of the lamp. In particular, it holds here that the control circuit is configured such that an upper limit of the interval becomes smaller when dimming of the lamp increases, and vice versa. In particular, it holds that this upper limit is equal to the predetermined value mentioned. In other words, if a lamp is dimmed, the lamp current at which the lamp provides the desired optimum efficiency will also decrease.

In particular, it holds that the first current is an alternating current and that the second current is an alternating current.

A problem that may occur is that controlling both the gas discharge lamp with the second alternating voltage and the filaments of the gas discharge lamp with the first current and/or the second current is not optimal for somewhat larger powers at large distances (i.e., with longer wiring) between the power circuit and the lamp. This is to say that no optimal efficiency is provided. The reason is that with lamps of larger powers the filaments are low-ohmic. The resistance and the reactive impedance of the wiring between the power circuit and the lamp are then, especially at high-frequency control, soon greater than the resistance of the filaments. It is then difficult with the standard method (resonance capacitor in series with the filaments) to provide the lamp during preheating, in normal operation and during dimming, with the proper current and voltages, certainly if there is also a substantial variation in the lamp voltage. Issues include the maximum voltage across the lamp during preheating, the value of and the variations in the lamp current in normal operation and during dimming given different lengths of the lamp wiring, and losses in the lamp wiring. According to a particular embodiment of the invention, it holds for this purpose that the driver circuit includes a first resonant circuit for generating the second alternating voltage and that the heating circuit includes a second resonant circuit for generating the first current and the second current. As the driver circuit and the heating circuit each have a resonant circuit of their own and hence can be regulated independently of each other, the lamp current on the one hand and the first and second current on the other can be set independently of each other. In particular, the frequency of the second alternating voltage and hence the frequency of the lamp current on the one hand and the frequency of the first and second current on the other can be set independently of each other.

Preferably, it holds that the power circuit is configured such that the first current and/or the second current can also be generated for preheating of the lamp when the lamp is not burning yet and the second alternating voltage is not generated either. According to the above-mentioned embodiment with the two resonant circuits operating independently of each other, during preheating, the first current and/or the second current can also be set independently of the first alternating voltage which is used for starting up the gas discharge lamp. In particular, it then holds that for the lamp current the frequency can be chosen such that the reactive components (coils, capacitors) can be small, the switching losses do not become unduly large, and the efficiency of the lamp is sufficiently high, while also EMC is not a problem. At the heating circuit, the frequency of the first current and/or the second current can be chosen such that the impedance of the lamp wiring and the losses in the lamp wiring remain sufficiently low, and the dimensions of the reactive components do not become unduly large, while the chosen frequency is preferably above the audible range and below the minimum frequency of the lamp current.

Preferably, it holds that a first output terminal of the heating circuit is connected to a first end of the primary side of a first transformer, a second output terminal for the heating circuit is connected to a second end of the primary side of a second transformer, a second end of the primary side of the first transformer is connected to a first end of the primary side of the second transformer, a first and second end of a secondary side of the first transformer are respectively connected to the first and second connecting terminal of the first filament and a first and second end of the secondary side of the second transformer are respectively connected to the first and second connecting terminal of the second filament. In this way, the heating circuit is galvanically separated from the lamp. In particular, it holds furthermore that a first output terminal of the driver circuit is connected via a first resistance to a first terminal of a direct voltage source, the first output terminal of the driver circuit is connected via a second resistance to a second terminal of the direct voltage source or to ground, a second output terminal of the driver circuit is connected via a third resistance to the first terminal of the direct voltage source, the second output terminal of the driver circuit is connected via a fourth resistance to the second terminal of the direct voltage source or to ground, wherein the first output terminal of the driver circuit is connected via a first voltage divider to the second terminal of the direct voltage source or to ground, and the second output terminal of the driver circuit is connected via a second voltage divider to the second terminal of the direct voltage source or to ground for measuring the voltage between the first voltage divider and the second voltage divider for being able to calculate from the measuring results of this measurement a leakage current from the lamp to ground and/or for being able to calculate from the measuring results of this measurement a direct voltage across the lamp and/or for determining from the measuring results if there is a leakage current path between the first and second output terminal of the driver circuit. With this, the problem can be solved that if in a lamp at the end of its life rectifying effects are going to occur, one end of the lamp gets overheated and/or the power circuit gets damaged.

When the lamp is implemented as a UV lamp, it is typically placed in a glass housing which is surrounded by the water which is to be cleaned. It is then desirable to be able to detect if there is water in the sleeve because the lamp then cannot attain its optimum temperature anymore and thereby generates too little UV light. Through the particular embodiment of the invention as described above, it is possible to determine the magnitude of any leakage current to earth (via the water). This can be done prior to switch-on of the lamp but also in operation. Also, it is possible to determine if there is a leakage current path between the two output terminals of the driver circuit. For the detection of water in the sleeve it is no longer necessary for such water to be in electrical contact with the earth. This can be carried out prior to switching on the lamp.

By measuring in operation, with the aid of the voltage dividers, the direct voltage across the lamp, it can be established if rectification through the lamp occurs, which may signify that the lamp is at the end of its life.

It is of importance to be able to test the filaments and the wiring of the power circuit to the lamp. Thus, it is of importance to be able to detect an interruption or a short circuit of the filaments. This can be carried out with the first and second test to be described below. Further, too long a wiring can have as a consequence that the alternating current resistance or impedance of the wiring becomes greater than foreseen, as a result of which preheating is no longer clone with the proper current. Such preheating is carried out with the aid of the first and second current mentioned. Too high an impedance would, at the desired first and second current, require a higher voltage than the heating circuit can supply. A detection of a too long wiring can also be carried out with the first and second test. Further, the capacity of the wiring may shift the frequency with which the resonant circuit formed by the power circuit, wiring and lamp has to be controlled to achieve the proper first alternating voltage. This capacity of the wiring or the needed ignition frequency (the frequency of the first voltage) can be determined beforehand with the first or second test. If the capacity of the wiring has been determined, the influence of this capacity on the frequency mentioned can be eliminated by adjusting the frequency of the first voltage to the influence of the capacity of the wiring on the resonant frequency.

In a particular embodiment of the power circuit, it further holds that the control circuit is configured to carry out the first test wherein the driver circuit is activated while the heating circuit is deactivated and wherein a third alternating voltage generated by the control circuit is so low that in case of a broken or short-circuited lamp the driver circuit cannot get broken as a result of the broken or short-circuited lamp or wiring and wherein the control circuit is configured for carrying out the first test to measure the third voltage or a voltage related thereto and the lamp current or a current related thereto. From the measured voltage and currents it is possible to calculate resistance, self-induction and capacity of the wiring which runs from the driver circuit to the lamp, including the resistance, capacity and self-induction of the lamp. Depending on the results it can be decided if and how the lamp must be ignited. This decision making process can be carried out through a predetermined algorithm in the control. Also, it holds according to a particular embodiment that the control circuit is configured to carry out the second test wherein the driver circuit is deactivated while the heating circuit is activated and wherein the generated first current and/or the generated second current are each so low that in case of a broken or short-circuited lamp or wiring the heating circuit cannot get broken as a result of the broken or short-circuited lamp or wiring and wherein the control circuit is configured for carrying out the second test to measure the first current or a current related thereto, the second current or a current related thereto, a voltage on output terminals of the heating circuit or a voltage related thereto. Also on the basis of these measured currents and voltages, it is possible to calculate resistance, self-induction and capacity of the wiring of the heating circuit to the lamp and including the resistance, self-induction and capacity of the lamp. Depending on these results, possibly in combination with the results of the first test, it can be decided if and how the lamp must be ignited. This can be carried out by the above-mentioned algorithms.

The invention will be elucidated in more detail on the basis of the drawings. In the drawings.

Figure 7:
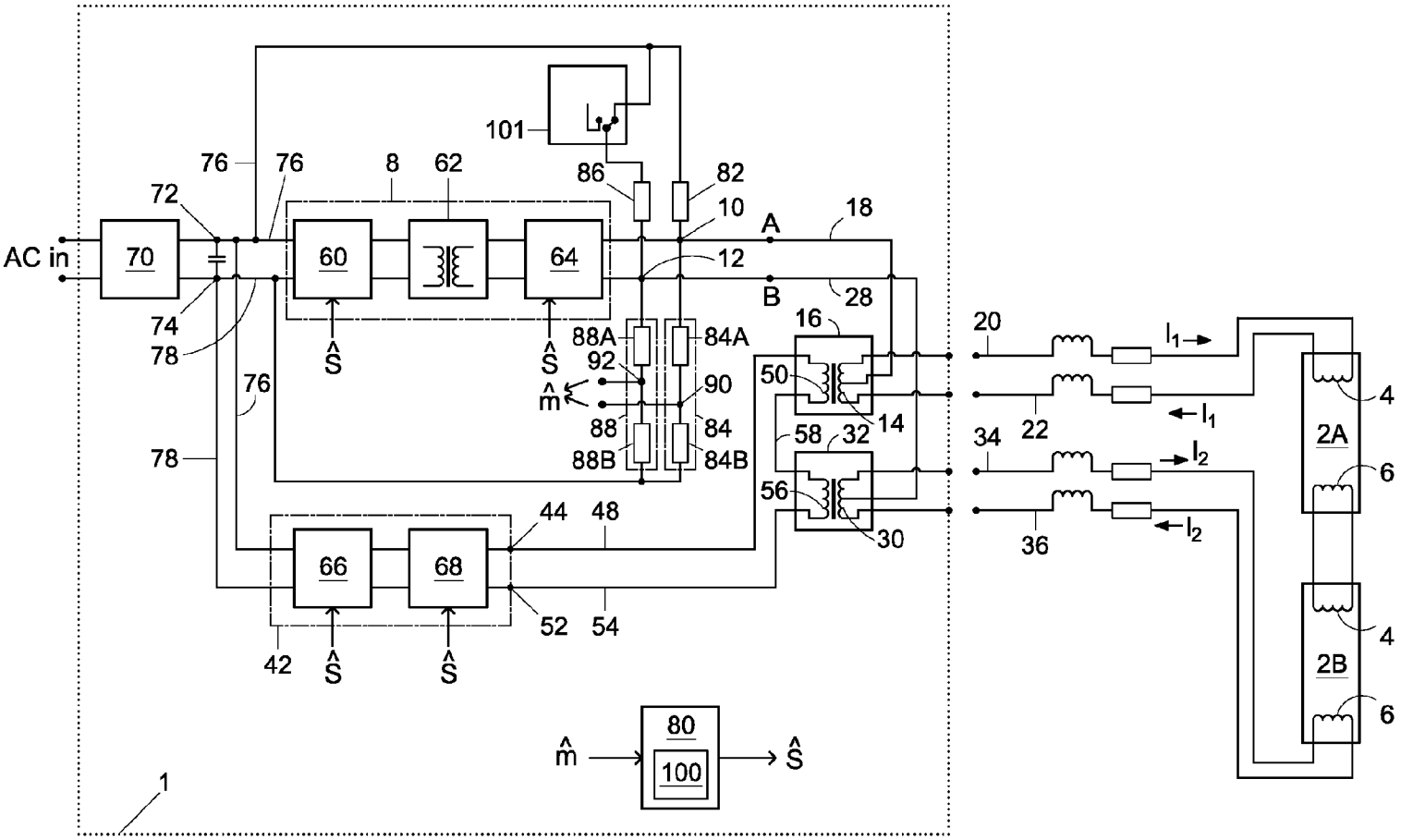
Figure 8:
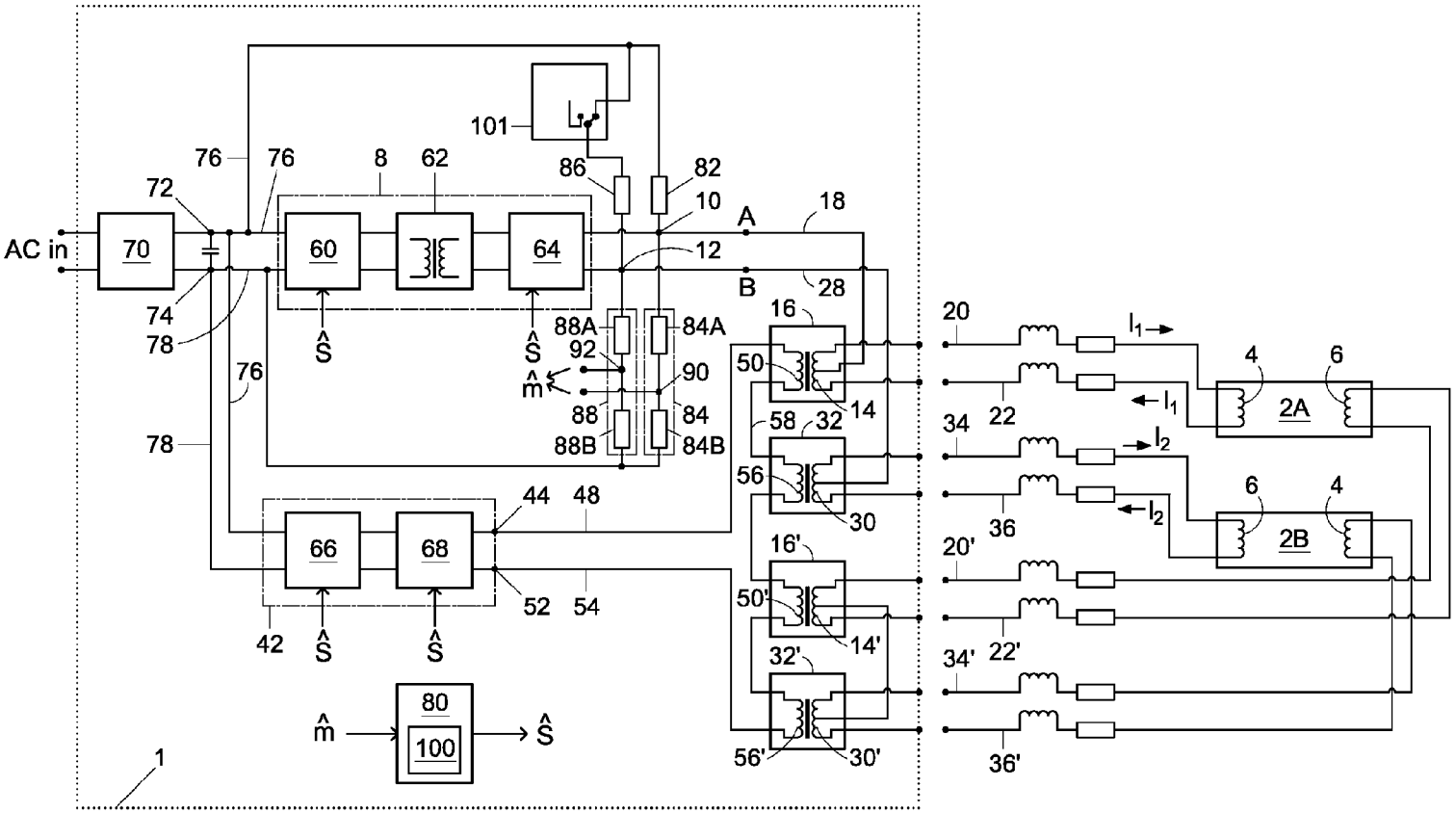
Figure 9:
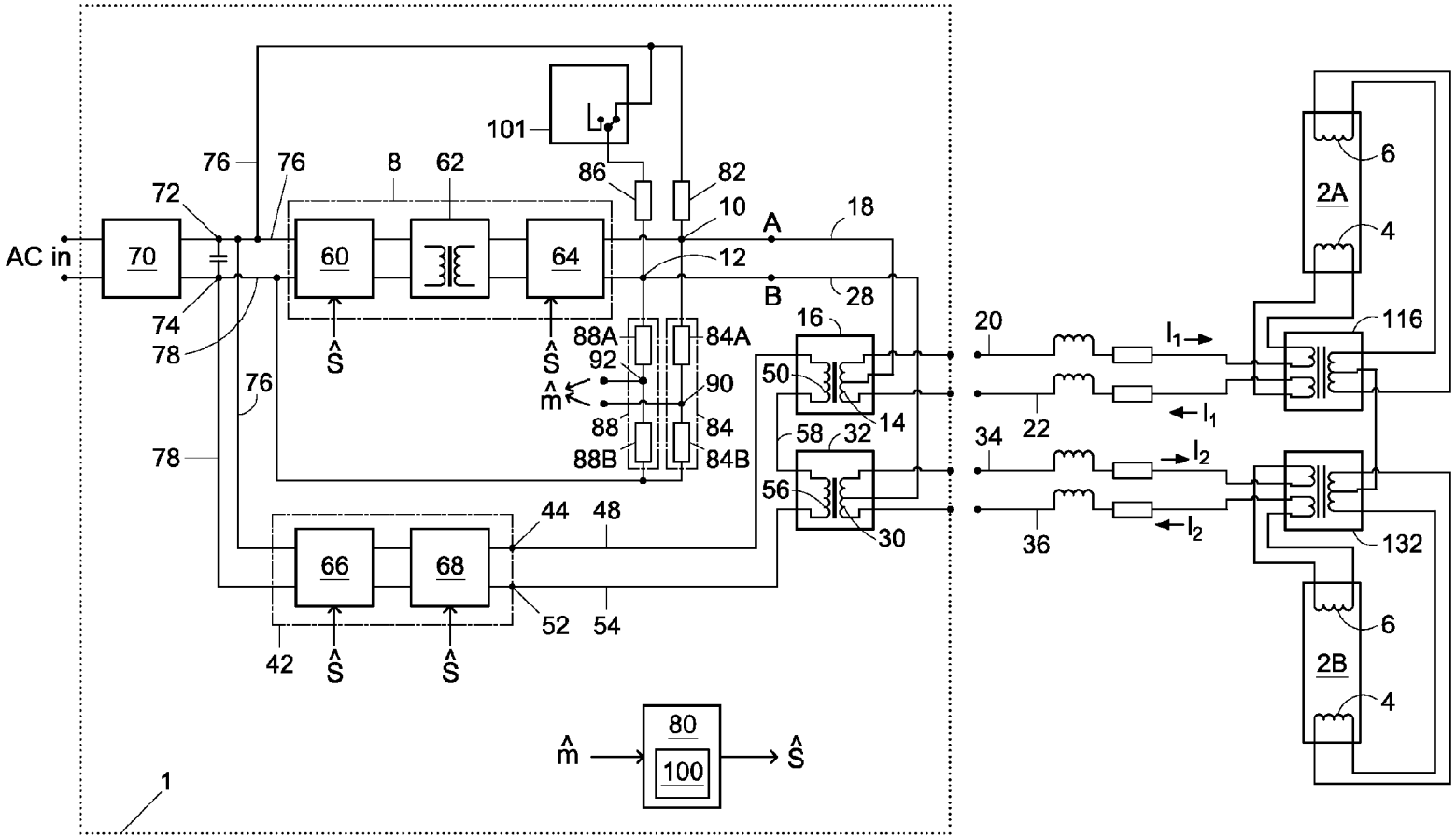

FIGS. 7-9 respectively show each an exemplary embodiment in which two gas discharge lamps can be connected in series.

Figure 1:
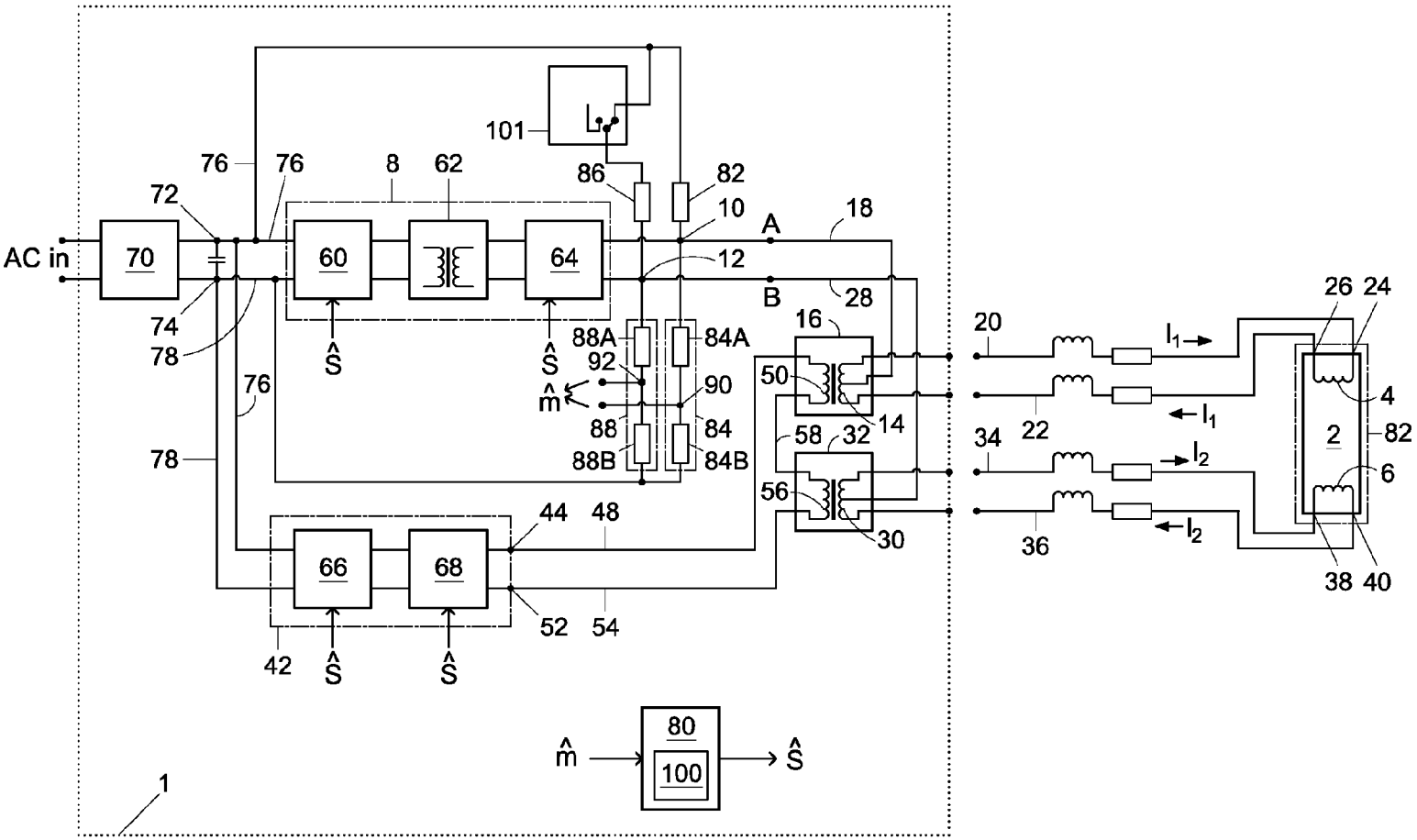
FIG. 1 shows a possible embodiment of a power circuit according to the invention which is coupled to a gas discharge lamp.

In FIG. 1, a possible embodiment of a power circuit according to the invention is denoted with reference numeral 1. The power circuit is coupled to a gas discharge lamp 2 provided with a first filament 4 and a second filament 6. The gas discharge lamp 2 in this example is implemented as a UV lamp, in particular a low-pressure amalgam lamp. The lamp in this example has a power of 500 watts at a nominal current of 8 amperes (hereinafter: amps).

The power circuit includes an electronic driver circuit 8 for generating a first alternating voltage between the first and second filament for starting up the gas discharge lamp and for generating a second alternating voltage between the first and second filament for having the gas discharge lamp burn after it has been started up. The driver circuit is provided with a first connecting terminal 10 and a second connecting terminal 12. The first terminal 10 is connected via a secondary winding 14 of a transformer 16 to the first filament 4. More particularly, the first terminal is connected to the secondary winding 14 of the transformer 16 via a wire 18. The ends of the secondary winding 14 are respectively connected via wires 20 and 22 to connecting terminals 24 and 26 of the first filament 4. Entirely analogously, the terminal 12 is connected via a wire 28 to a secondary winding 30 of a second transformer 32. The ends of the secondary winding 30 are respectively connected via wires 34 and 36 to a first connecting terminal 38 and a second connecting terminal 40, respectively, of the second filament 6. It holds, therefore, that the second terminal 12 is connected via a second transformer 32 to the filament 6.

The power circuit further includes an electronic heating circuit 42 for, at least before and possibly during generation of the first alternating voltage and during generation of the second alternating voltage, generating a first current through the first filament for heating the first filament and/or for generating a second current through the second filament for heating the second filament. The heating circuit in this example takes care of both preheating of the two filaments and additional heating during dimming.

The heating circuit 42 is provided with a first output terminal 44 which is connected via a wire 48 to a first end of a primary winding 50 of the first transformer 16. A second output terminal 52 of the heating circuit is connected via a wire 54 to a second end of a primary winding 56 of the second transformer 32. A second end of the primary winding 50 and a first end of the primary winding 56 (which is not connected to the wire 54) are mutually interconnected through a wire 58.

In this example, the driver circuit 8 includes a first circuit 60 for generating an alternating voltage, a transformer 62, and a first resonant circuit 64 to which the alternating voltage generated with the first circuit is supplied via the transformer, for generating with the first resonant circuit the second alternating voltage and possibly also the first alternating voltage. The first and second alternating voltage which are generated with the resonant circuit are slightly sinusoidal. By contrast, the alternating voltage which is generated with the aid of the first circuit 60 has, for example, a square wave form.

The heating circuit includes a second circuit 66 for generating an alternating voltage (for example, of square wave form), whereby the generated alternating voltage is supplied to a second resonant circuit 68 for generating with the second resonant circuit the first current and/or the second current. The first and second currents $I_1$ and $I_2$ are each an alternating current having the shape of a sine.

In this example, it holds that the frequency of the first current $I_1$ and the second current $I_2$ is smaller than the frequency of the first and second alternating voltage. In this example, the frequency of the alternating current $I_1$ and the alternating current $I_2$ is 10-30 kHz.

The power circuit further includes an AC/DC converter to which, in use, an alternating voltage is supplied for generating a direct voltage. The AC/DC converter thus forms a direct voltage source with a first terminal 72 and a second terminal 74. The terminals 72 and 74 are connected via wires 76, 78 to the first circuit 60 and the second circuit 66, i.e., to the input side of the driver circuit 8 and the heating circuit 42. The power circuit furthermore includes a control circuit 80 for controlling the first circuit 60, the second circuit 66 and measuring the first and second alternating voltage and the lamp current and the first and second currents and the voltage across the secondary windings 14 and 30 of transformers 16 and 32. The lamp current $I_{lamp}$ is the current running between the first filament 4 and the second filament 6, as a result of which the lamp, after it has been ignited, burns. The operation of the power circuit such as it has been described up to this point, is as follows.

To the AC/DC converter 70 an alternating voltage of, for example, 220 volts is applied. The AC/DC converter in this example generates on the terminals 72, 74 a direct voltage of 430 volts. The control circuit 80 controls the first circuit 60 so that an alternating voltage, for example, in the form of a square wave, is generated with a relatively high frequency of, for example, 100-200 kHz. The transformer 62 takes care of a galvanic separation between the first circuit 60 and the first resonant circuit 64. The resonant circuit 64 is supplied via the transformer 62 with the alternating voltage mentioned which is generated by the first circuit 60. On the basis of this alternating voltage, the resonant circuit 64 generates a first alternating voltage which has the relatively high frequency mentioned. For generating the first alternating voltage with the relatively high frequency mentioned using the resonant circuit 64 and which, in this example, has the shape of a sine, the control circuit 80, with the aid of a microprocessor 100, controls the resonant circuit with the proper frequency, such that the first voltage obtains the desired amplitude for starting up the lamp. This first alternating voltage is supplied via the wires 18 and 28 to, respectively, the secondary side of the first transformer 16 and the secondary side of the second transformer 32. The effect is that this alternating voltage, via the wires 20, 22 and the wires 34, 36, ends up between the first filament 4 and the second filament 6. This has as a consequence that in lamp 2 an electrical discharge arises. After in lamp 2 a continuous electrical discharge has been brought about, the control circuit 80 controls the first circuit 60, such that the latter proceeds to generate a second alternating voltage with a lower frequency, in this example a frequency of 35-100 kHz. The result is that with the aid of the resonant circuit 64 a second alternating voltage is generated which is at least substantially sine-shaped and is applied across the lamp 2, i.e., this second alternating voltage is between the filaments 4 and 6. On the basis of this first alternating voltage, the lamp ignites, and the lamp current $I_{lamp}$ starts to flow between the first filament 4 and the second filament 6, as a result of which the lamp burns. In this example, the nominal lamp current is 8 amps. This means that a current of about 4 amps passes through each of the wires 20 and 22. Entirely analogously, this means that a current of approximately 4 amps passes through each of the wires 34 and 36.

Figure 2:
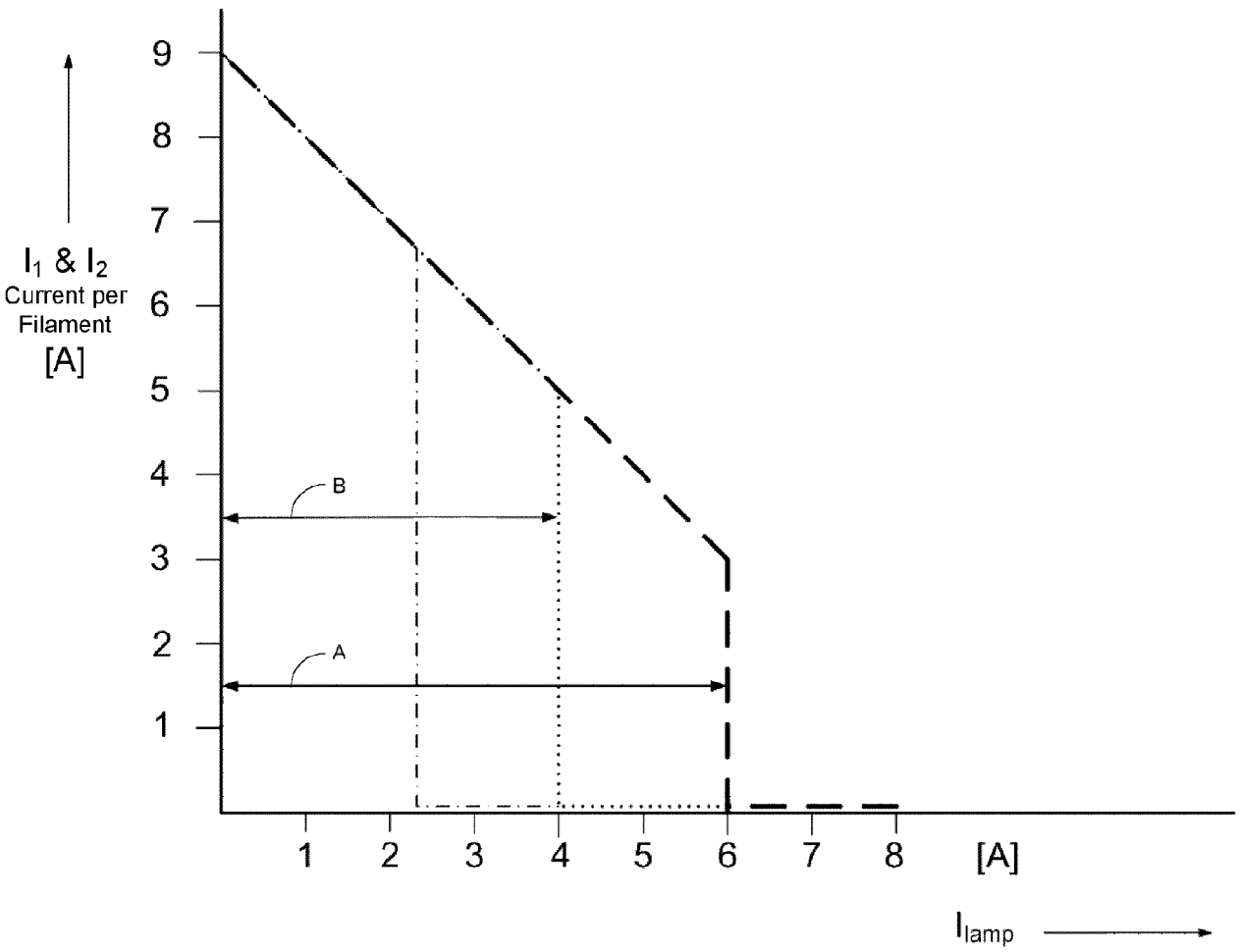
FIG. 2 shows a relation between $I_1$ and $I_2$ and $I_{lamp}$ for a first embodiment of the control circuit.

In this example, the lamp is a 500 W UV lamp which is included in a glass housing 82 schematically indicated in the drawing. This glass housing 82, in use, is immersed in a basin with water for disinfecting the water with the UV light. If the water gets cold, the lamp 2 will start to cool. As a result of the cooling of the lamp, the magnitude of the lamp current will fall. The magnitude of the lamp current is detected with the aid of the control circuit 80 which for this purpose is connected to the resonant circuit 64. In FIG. 2 the dashed line denotes how the control unit regulates the first current $I_1$ and the second current $I_2$ in dependence upon the magnitude of the lamp current $I_{lamp}$. When the lamp current has fallen from 8 amps to 6 amps, the control circuit 80 causes the heating circuit 42 to be switched on. The heating circuit 42 thereupon causes an alternating current to pass through the wires 48 and 54, as set out hereinabove. The result of all this is that a first alternating current is going to run through the filament 4 via the wires 20 and 22 and that a second alternating current is going to run through the filament 6 via the wires 34 and 36. The first alternating current is denoted with $I_1$ and the second alternating current is denoted with $I_2$. The first alternating current $I_1$ and the second alternating current $I_2$ are equally large in this example. The first alternating current $I_1$, when the lamp current is almost equal to 6 amps, has a value of 3 or 0 amps. All this is schematically shown in FIG. 2 with the aid of the dashed line. The result is that as a result of the first current $I_1$ and the second current $I_2$, respectively flowing through the first filament 4 and the second filament 6, the lamp 2, i.e., the gas in the lamp, will be heated up. When the lamp current in the lamp falls further below 6 amps, the control 80 will cause the first current $I_1$ and the second current $I_2$ to rise, in this example to a maximum value of 9 amps when the lamp current is nearly zero. As a result of the current $I_1$ and $I_2$, however, the temperature of the lamp will rise again, with the result that the lamp current will also rise again. The first current $I_1$ and the second current $I_2$ will then proceed to decrease again according to the dashed line of FIG. 2. When the lamp current exceeds 6 amps again, the first current $I_1$ and the second current $I_2$ will become equal to zero again. Owing to the lamp current being always regulated to a value above 6 amps in this way, this has as an effect that the UV lamp will always work with a relatively high efficiency.

In this example, it holds, as appears from FIG. 2, that the control circuit is configured for, when the magnitude of the lamp current is in a predetermined interval A, increasing the magnitude of the first current and the magnitude of the second current if the lamp current decreases and vice versa. Also, it holds that the magnitude of the first current and the magnitude of the second current becomes equal to zero when the lamp current becomes greater than a predetermined value. In this example, this predetermined value is equal to an upper limit of the interval A, i.e., equal to 6 amps. The interval is indicated in FIG. 2 with line segment A.

The control circuit is furthermore configured to dim the lamp 2 in a known manner. To this end, the control circuit controls the driver circuit 8 in a known manner. When the lamp is dimmed to, for example, 300 W, the lamp current in the lamp will also decrease. The magnitude of $I_{lamp}$ at which the magnitude of $I_1$ and the magnitude of $I_2$ is going to rise ($I_{lamp\text{-}s}$) becomes smaller when dimming increases. When the lamp is burning undimmed, this magnitude of $I_{lamp\text{-}s}$ is 6 amps. When the lamp is dimmed to 300 W as indicated, the magnitude of $I_{lamp\text{-}s}$ then becomes, for example, 4 amps. If the lamp is dimmed still further, $I_{lamp\text{-}s}$ will decrease further. This means that it is no longer necessary to additionally heat the lamp with the aid of the incandescent filaments to a lamp current of 6 amps, but to, for example, 4 amps. This is because the decrease of the lamp current is not a result of the decrease of the temperature of the lamp, but a result of dimming. Upon dimming of the lamp, the control circuit will proceed to use a different relation between the magnitude of $I_1$ and $I_2$ on the one hand and the magnitude of the lamp current $I_{lamp}$ on the other. The control circuit, however, ensures in this case that when the lamp, for example, is dimmed, the first current $I_1$ and the second current $I_2$ are equal to zero unless the lamp current falls below 4 amps. In this last case (see dotted line in FIG. 2), the current $I_1$ and $I_2$ are set from zero to a value of about 5 amps. From that point, the currents $I_1$ and $I_2$ will run up further upon decrease of the lamp current. If the temperature is going to rise again, the lamp current will rise again. If the lamp current rises again, the control unit causes the magnitude of the current $I_1$ and the magnitude of the current $I_2$ to fall again according to the dotted line of FIG. 2. If the lamp current rises above 4 amps again, the magnitude of the first current $I_1$ and the magnitude of the second current $I_2$ will become equal to zero again. It holds in this example that the control circuit is configured such that an upper limit of the interval becomes smaller when dimming of the lamp increases and vice versa. In this example, the upper limit of the interval in case of dimming of the lamp is lowered to a particular value of the lamp current, for example, to 4 amps, so that the interval as indicated in FIG. 2 with line segment B is obtained. The respective upper limit in this example is again equal to the predetermined value, while it holds that when the lamp current is greater than this predetermined value, the current $I_1$ and the current $I_2$ become equal to zero again. In this example, it holds that both for the rising of the lamp current $I_{lamp}$ and for the falling of the lamp current $I_{lamp}$ the dotted line curve denotes the magnitude of the corresponding first current $I_1$ and the second current $I_2$. Of course, it holds that, when the lamp is further dimmed to a defined power that is less than 300 W, the control unit causes the predetermined value to decrease further, as indicated, for example, with the aid of the chain-dotted line/dashed line when the lamp is dimmed further to, for example, 200 W.

Figure 3:
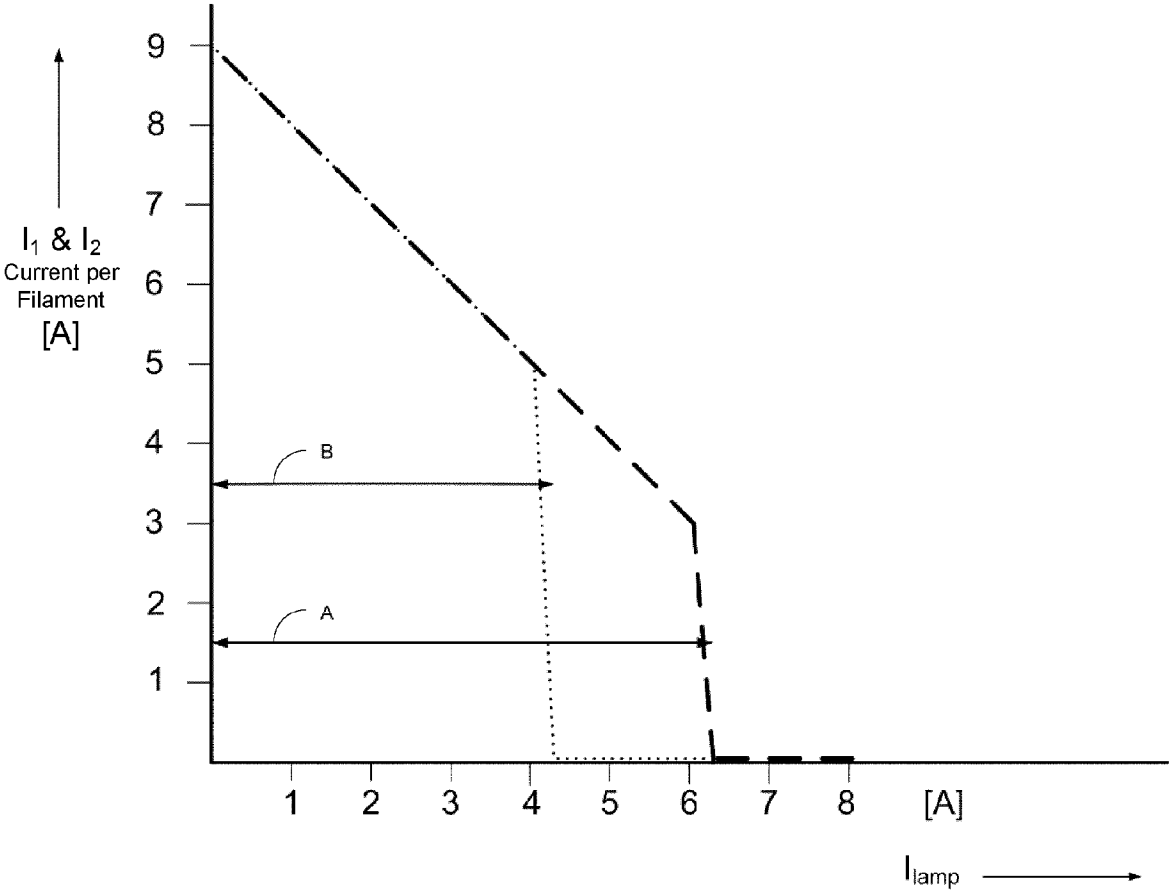
FIG. 3 shows a relation between $I_1$ and $I_2$ and $I_{lamp}$ for a second embodiment of the control circuit.

In FIG. 3 another possible relation between $I_{lamp}$ and the first current $I_1$ and the second current $I_2$ is shown. The dashed line again reflects regulation when the lamp is used at the nominal power of 500 watts, hence undimmed. It shows that when the lamp current falls below 6.2 amps, then in the trajectory from 6.2-6 amps the control unit causes $I_1$ and $I_2$ to run up relatively fast to 3 amps. When the lamp current falls further below 6 amps, $I_1$ and $I_2$ increase less fast. When the lamp current in the lamp is going to rise again due to the temperature of the lamp rising as a result of heat-up, the dashed curve also reflects the relation between the magnitude of the lamp current $I_{lamp}$ and the magnitude of the first current $I_1$ and the magnitude of the second current $I_2$. Here also, it holds that when the magnitude of the lamp current $I_{lamp}$ decreases, the magnitude of the first current $I_1$ and the magnitude of the second current $I_2$ increases when the lamp current $I_{lamp}$ is in a predetermined interval, which in this example extends from 0-6.2 amps. If the lamp is dimmed, an upper limit of the interval A will decrease, after which, for example, given a defined extent of dimming, the interval B is applied. During this extent of dimming, the dotted line is followed. Here, it holds again that the magnitude of the current $I_1$ and $I_2$ will increase when the lamp current decreases and vice versa. Here also, it holds that upon a decrease of the lamp current to below 4.2 amps (given the extent of dimming referred to), the magnitude of the current $I_1$ and $I_2$ first increases relatively fast and then, upon a further decrease of the lamp current, the magnitude of the current $I_1$ and $I_2$ increases relatively slowly.

Figure 4:
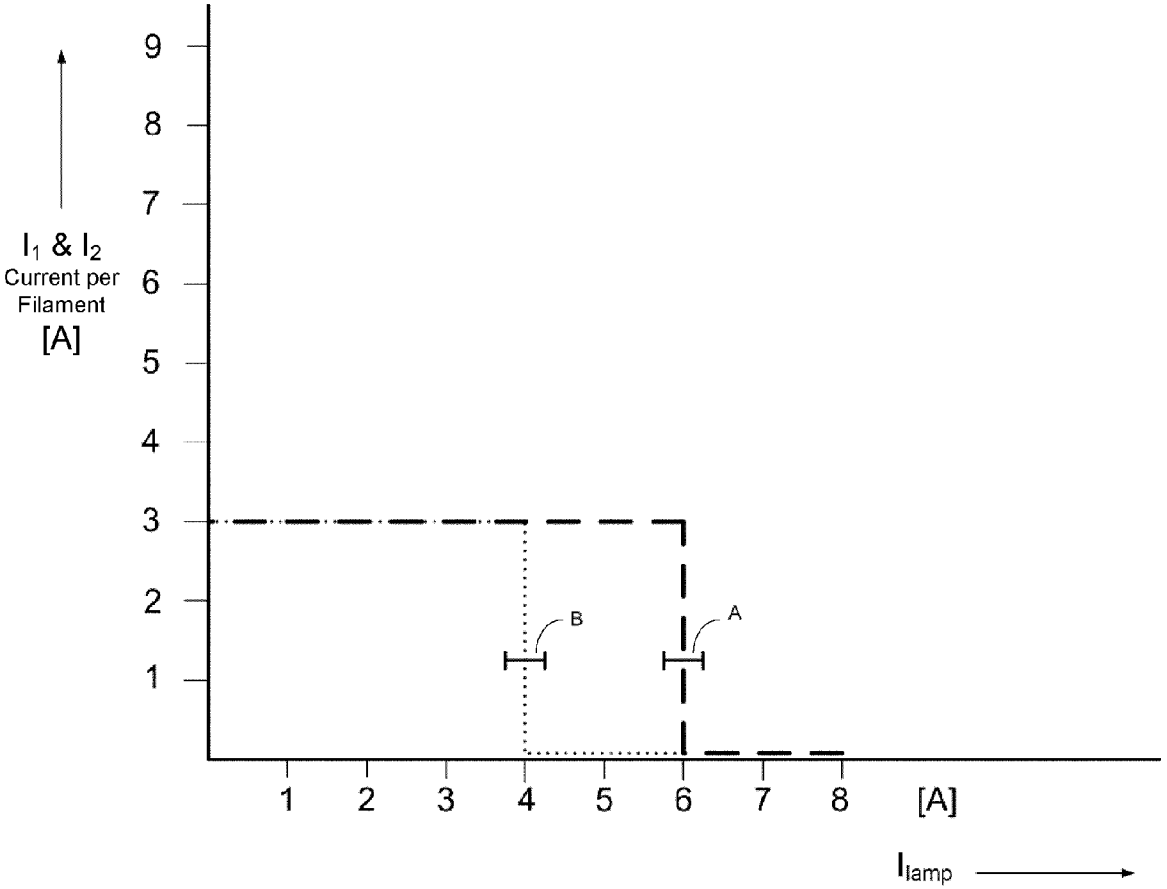
FIG. 4 shows a relation between $I_1$ and $I_2$ and $I_{lamp}$ for a third embodiment of the control circuit.

FIG. 4 represents yet another possible relation between the lamp current $I_{lamp}$ and the magnitude of the current $I_1$ and $I_2$ that may be implemented in the control unit. In this example, it holds that when the lamp current at nominal power of the lamp falls below 6 amps, the magnitude of the current $I_1$ and $I_2$ is immediately set to 3 amps by the control unit. Upon a further decrease of the lamp current $I_{lamp}$, the magnitude of the current $I_1$ and the magnitude of the current $I_2$ remains the same. When the temperature of the lamp increases again, the lamp current will rise again. When the lamp current rises above 6 amps, the magnitude of the current $I_1$ and the magnitude of the current $I_2$ will become equal to zero again. Here, it thus holds that when the magnitude of the lamp current is within a predetermined interval A (see line segment A in FIG. 4), the magnitude of the first current and the magnitude of the second current remains the same if the lamp current decreases and vice versa. Also, it holds that the magnitude of the first current and the magnitude of the second current becomes zero when the lamp current becomes greater than a predetermined value, this predetermined value in this example being equal to the upper limit of the interval A. When the lamp is dimmed to a defined power, then, given such power, the relation between the magnitude of the lamp current $I_{lamp}$ and the magnitude of the current $I_1$ and $I_2$ is given by the dotted line. In the event of dimming of the lamp to that defined power, for example, the interval B as indicated in FIG. 4 is obtained. Also for this extent of dimming, it holds that when the magnitude of the lamp current is within the predetermined interval B, the magnitude of the first current and the magnitude of the second current remains the same if the lamp current decreases and vice versa. In addition, it holds that the control circuit is configured such that an upper limit of the interval becomes smaller when the dimming of the lamp increases and vice versa (compare the upper limit of the interval A with the upper limit of the interval B in FIG. 4). It is useful, however, not to allow the first and second current to rise above a defined value (e.g., 7 amps), if the decrease of the lamp current were to give a reason for this. The heating circuit then does not have to be suitable for 9 amps but just for 7 amps. Of course, other curves are also conceivable.

Figure 5:
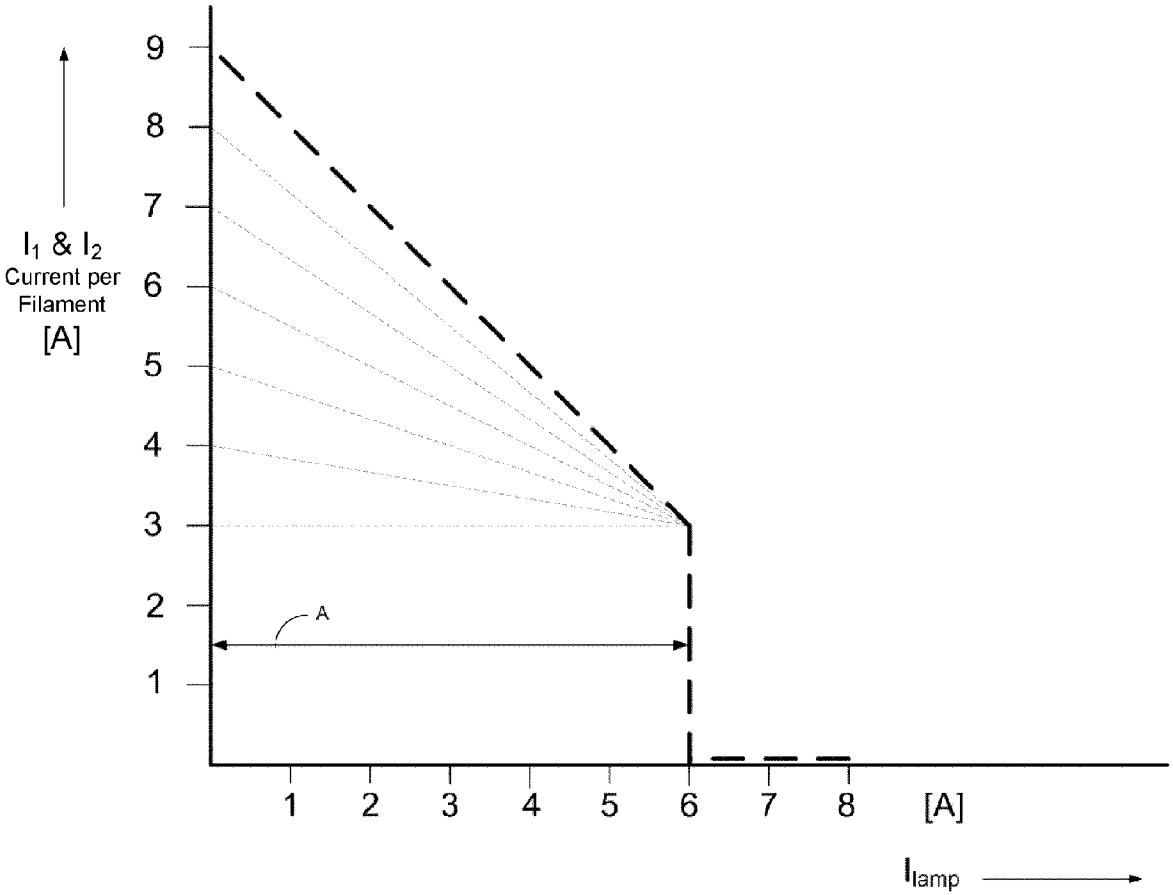
FIG. 5 shows possible relations between $I_1$ and $I_2$ and $I_{lamp}$ for other embodiments of the control circuit.
Figure 6:
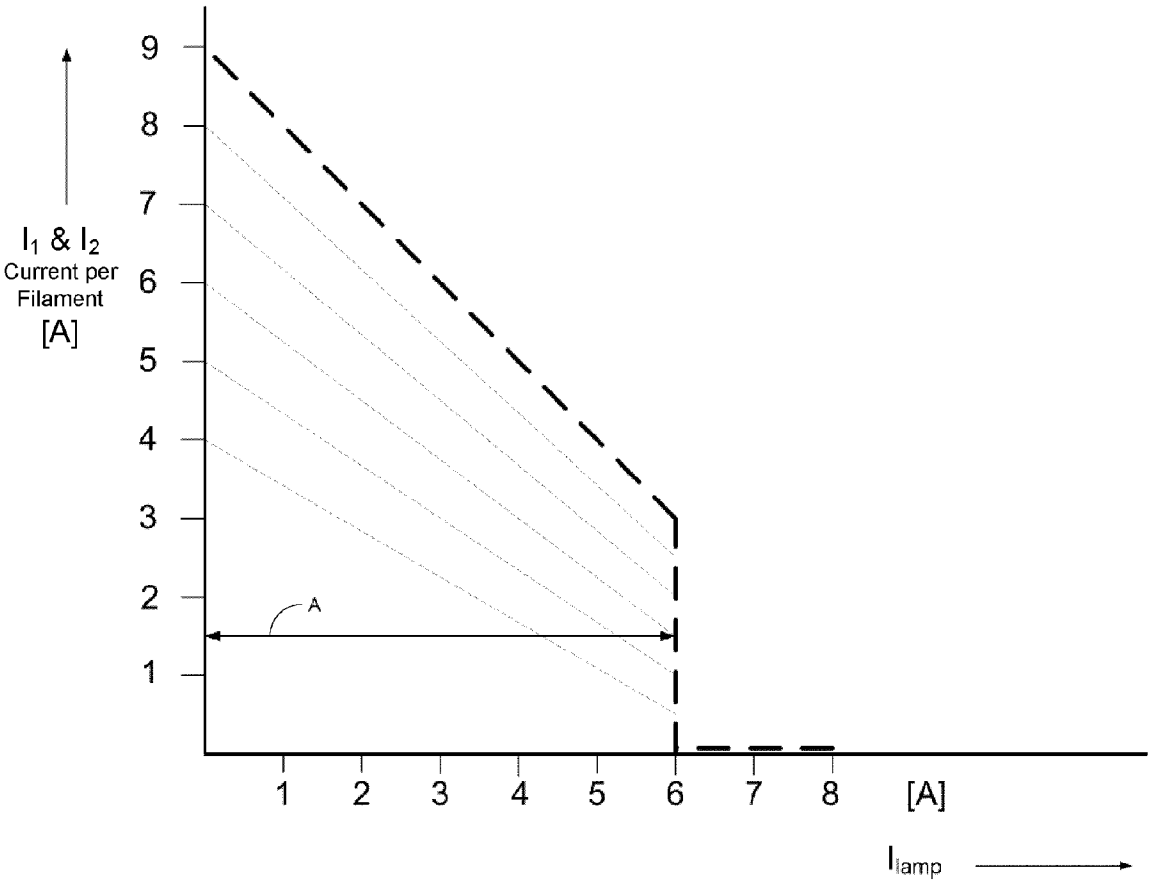
FIG. 6 shows possible relations between $I_1$ and $I_2$ and $I_{lamp}$ for another embodiment of the control circuit.

The current to which $I_1$ and $I_2$ are set if the lamp current falls below the upper limit of interval A may deviate from 3 amps and the magnitude of $I_1$ and $I_2$ may deviate from 9 amps if the lamp current were to fall to 0 amps, see FIG. 5 and FIG. 6.

In this example, it holds that the driver circuit 8 and the heating circuit 42 are mutually separated individual circuits which can be operated independently of each other. Accordingly, each circuit is provided with its own resonant circuit. This entails important advantages. In this connection, it is already noted at this point that the heating circuit can generate the first current $I_1$ and the second current $I_2$ as discussed above when the driver circuit generates the second alternating voltage for controlling the lamp in operation. It is also possible, however, when the lamp is not controlled with the aid of the driver circuit and/or when the lamp is started up when the driver circuit generates the first alternating voltage, to heat the incandescent filaments with the heating circuit. Owing to the driver circuit and the heating circuit being regulatable independently of each other, however, still further important advantages arise. In lamps 2 of higher power, the filament wires 4, 6 are low-ohmic. The resistance and the reactive impedance of the wiring 20, 22, 24, 26 are then, especially in the case of high-frequency control, soon greater than the resistance of the filaments 4 and 6. It is then difficult with the standard method (resonance capacitor in series with the filaments) to provide the lamp during preheating, in normal operation and during dimming, with the proper current and voltages, certainly if there is also a substantial variation in the lamp voltage. Issues include the maximum voltage across the lamp during preheating, and the value of and the variation in the currents through the filaments in normal operation and during dimming given different lengths of the lamp wiring 20, 22, 34, 36. Further, the losses in the lamp wiring are an issue. Owing to a driver circuit being present for the arc discharge (i.e., for generating the second voltage and the corresponding lamp current), the frequency can be chosen such that the reactive components are small, the switching losses do not become unduly large, the efficiency of the lamp is sufficiently high, and EMC is not a problem. Also, with the aid of the heating circuit, the frequency of the first current and the second current can be chosen such that the impedance of, and the losses in, the lamp wiring remain sufficiently low and the dimensions of the reactive components do not become unduly large, while this frequency is preferably above the audible range. To put it differently: because the frequencies of the first voltage and the second voltage on the one hand and the frequency of the first current and the second current on the other can be chosen independently of each other, all this can be set optimally. According to the above-mentioned embodiment with the two resonant circuits operating independently of each other, it is also possible, during preheating, to set the first current and/or the second current independently of the first alternating voltage which is used for starting up the gas discharge lamp. In particular, it then holds that for the lamp current the frequency can be chosen such that the reactive components (coils, capacitors) can be small, the switching losses do not become unduly large, and the efficiency of the lamp is sufficiently high, and also EMC not being a problem. At the heating circuit, the frequency of the first current and/or the second current can be chosen such that the impedance of the lamp wiring and the losses in the lamp wiring remain sufficiently low, and the dimensions of the reactive components do not become unduly large, while the chosen frequency is preferably above the audible range.

In this example it holds furthermore that the first terminal 10 of driver circuit 8 is connected via a first resistance 82 to the first terminal 72 of the direct voltage source 70. Furthermore, it holds that the first terminal 10 is connected via a second resistance 84 to a second terminal 74 of the direct voltage source 70. The second terminal 12 of the driver circuit is connected via a third resistance 86, via an electronic switch 101, to the first terminal 72 of the direct voltage source 70. Also, it holds that the second terminal 12 is connected via a resistance 88 to the second terminal 74 of the direct voltage source 70. In this example, it holds furthermore that the second resistance 84 is made up of a series connection of a resistance 84A and 84B which thus form a first voltage divider. Also, it holds that the resistance 88 is made up of a series connection of a resistance 88A and 88B which form a second voltage divider. Therefore, it also holds that the first terminal 10 is connected via a first voltage divider (84A, 84B) to the second terminal 74 of the direct voltage source 70 and that the second terminal 12 is likewise connected, via a second voltage divider (88A, 88B), to the second terminal 74 of the direct voltage source 70. The first voltage divider 84A, 84B provides a voltage on point 90 and the second voltage divider 88A, 88B provides a voltage on point 92. These voltages are supplied to the control circuit 80 via a lead which is denoted in the drawing with m̂. The resistances 82, 84A, 86, 88A are high-ohmic. High-ohmic is understood to mean a resistance that is greater than 1 MΩ. The resistances 84B and 88B are each of low-ohmic design. The ratio between the resistances 82, 84A, 86, 88A and 84B, 88B is such that on the points 90 and 92 there is a voltage that can be measured by microprocessor 100. In this example, the magnitude of the resistances 82, 86, 84A, and 88A is respectively equal to 2.4 MΩ. The magnitude of the resistances 84B and 88B is equal to 10 kΩ. By measuring the voltage on point 90 and the voltage on point 92, it can be calculated if and how much leakage current is flowing to earth via the water in which the lamp 2 is received and at too high a value of the leakage current it can be decided to switch off the circuit.

Before the lamp is switched on, it is also possible, by measuring the voltage on the points 90 and 92, respectively, to calculate if there is a leakage current path between the output terminals 10 and 12. Before the voltage on the points 90 and 92 is measured, the electronic switch 101 will be controlled by control 80, as a result of which the electrical connection to point 76 is interrupted. After the voltage measurement, the connection is restored again. When a preselected limit for this leakage current is exceeded, possibly an alert may be generated by the control 80. For the detection of the water in the housing 82 it is then not necessary anymore for such water to be in electrical contact with the earth.

Also, with the aid of the voltage dividers, i.e., by measuring the voltage on the points 90 and 92, respectively, the direct voltage across the lamp can be measured. If this direct voltage is there, this may mean that the lamp is at the end of its life, so that one end of the lamp may become overheated and/or the power circuit may be damaged or that the incandescent filaments have too low a temperature. Measuring of the direct voltage across the lamp by measuring voltage on the points 90 and 92, respectively, may lead to the unit being switched off if the measured voltage exceeds a preset limit, or to the heating current needing to be increased. In this example, the resistances 82 and 86 are connected (via an electronic switch 101) to the terminal 72 of the direct voltage source. It is also possible to connect these resistances to ground. Alternatively, it is also possible to connect the resistances 84 and 88 to ground instead of to the terminal 74 of the direct voltage source. In that case the calculations can be carried out in the same way as discussed above.

It is of importance to be able to test the filaments and the wiring of the power circuit to the lamp. Thus, it is of importance to be able to detect an interruption or a short circuit of the filaments. This can be carried out with the first and second test to be described below. Further, a too long wiring can have as a consequence that the resistance of the wiring becomes greater than envisaged, as a result of which preheating is not done with the proper current anymore. Such preheating is carried out with the aid of the first and second current mentioned. The voltage involved, given the greater resistance of the wiring, may then entail the current referred to being too small for preheating. A detection of a too long wiring can also be carried out with the first and second test. Further, the capacity of the wiring may shift the frequency with which the resonant circuit formed by the power circuit, wiring and lamp has to be controlled to achieve the proper ignition voltage. This capacity of the wiring or the ignition frequency needed (the frequency of the first voltage) can be predetermined with the first or second test. If the capacity of the wiring has been determined, the influence of this capacity can be eliminated by choosing the proper frequency.

In this example, it further holds that the control circuit 80 is configured to carry out the first test wherein the driver circuit 8 is activated while the heating circuit 42 is deactivated. It holds in this first test that the third alternating voltage and alternating current generated by the control circuit are so low that no damage to the power circuit can occur and no ionization occurs in the lamp. The third alternating voltage and alternating current between the output terminals 10 and 12 are measured and then parallel resistance, and parallel capacity of the wiring including lamp can be calculated by the microprocessor. On the basis of these results it can then be determined if and how the lamp must be ignited. It therefore holds, more generally, that the control circuit is configured for carrying out the first test to measure the third voltage or a voltage related thereto, and the lamp current or a current related thereto. The control circuit can, for example, measure these voltages and currents itself directly. Thus, the parallel resistance, and parallel capacity of the wiring including the lamp can be calculated. This can be done as follows. From the instantaneous values of voltage and current, the power can be calculated by multiplication and averaging. From squaring, averaging, and extraction of the roots of the instantaneous values, the effective values of voltage and current can be calculated. Apparent power is equal to Irms*Urms. From the real apparent power and the effective voltage and current, the resistive and reactive resistance can be calculated. From the reactive resistance and the frequency follows the effective parallel capacity.

The control circuit in this example is further configured to carry out the second test wherein the driver circuit 8 is deactivated while the heating circuit 42 is activated. For carrying out the second test, the generated first current $I_1$ and the generated second current $I_2$ are so low that in case of a broken or short-circuited lamp or wiring the heating circuit cannot get broken as a result of the broken or short-circuited lamp. The first current $I_1$ and the second current $I_2$ in this example are 0.1-2 amps. The control circuit is configured for carrying out the second test to measure the first current $I_1$ or a current related thereto, and/or the second current $I_2$ or a current related thereto, a voltage across the output terminals 44, 52 of the heating circuit or a voltage related thereto. On the basis of these measured voltages and currents, again series resistance and series self-induction of the wiring including the series resistance and series self-induction of the incandescent filament of the lamp can be calculated. This can be done as follows. From the instantaneous values of voltage and current, the power can be calculated by multiplication and averaging. From squaring, averaging, and extraction of the roots of the instantaneous values, the effective values of voltage and current can be calculated. Apparent power is equal to Irms*Urms. From the real apparent power and the effective voltage and current, the resistive and reactive resistance can be calculated. From the reactive resistance and the frequency follows the effective series self-induction.

The invention is not limited in any way to the exemplary embodiments outlined above. In this example, the power circuit is coupled to one lamp. It is also possible, and this is also applied by us, to drive two series-connected lamps with the aid of the power circuit.

Two lamps 2A and 2B can be connected in series as follows:

In FIG. 1 lamp 2 is removed and replaced by lamp 2A and 2B. Filament 6 of lamp 2A is connected to filament 4 of lamp 2B. Filament 6 of lamp 2A and filament 4 of lamp 2B in this way cannot be preheated and/or additionally heated. Filament 4 of lamp 2A and filament 6 of lamp 2B, however, can be preheated and/or additionally heated as discussed with reference to FIG. 1. The result is shown in FIG. 7.

Another way of connecting the lamps 2A and 2B in series is shown in FIG. 8. Compared with FIG. 1, two extra transformers 16' and 32' have been added to the power circuit. Filament 4 of lamp 2A is connected to the secondary winding of transformer 16 as shown in FIG. 1 for lamp 2. Filament 6 of lamp 2B is connected to the secondary winding of transformer 32 as shown in FIG. 1 for the filament 6 of the lamp 2. Two transformers 16' and 32' are added to the circuit according to FIG. 1, with the primary windings of the transformers 16, 16', 32, 32' connected in series with each other. The secondary winding of transformer 16' is connected to the second filament 6 of the lamp 2A. The secondary winding of transformer 32' is connected to the first filament of the lamp 2B. The central branches of the transformers 16' and 32' are connected to each other. All filaments can now be preheated and/or additionally heated as discussed with reference to FIG. 1.

Another way of connecting the lamps 2A and 2B in series is shown in FIG. 9. Compared with FIG. 1, two transformers 116, 132 have been added, whose secondary windings feed the filament 6 of the lamp 2A and the filament 4 of the lamp 2B. The central branches of the transformers 116 and 132 are connected to each other. Per transformer, there are two primary windings which are connected in series with the wires 20, 22 and 34, 36. All filaments can now be preheated and/or additionally heated In this example, the lamp is a UV lamp. It is also possible, however, to drive other types of gas discharge lamps. For the first circuit 60, a second circuit 66, the resonant circuits 64 and 68, circuits known per se can be used, so that these are not further elucidated here. Other embodiments of these circuits hence also belong to the invention.

The invention claimed is:

1. A power circuit for at least one gas discharge lamp comprising a first filament and a second filament, the power circuit including an electronic driver circuit for generating a first alternating voltage between the first and second filament for starting up the gas discharge lamp and for generating a second alternating voltage between the first and second filament for having the gas discharge lamp burn after it has been started up, wherein the power circuit further includes an electronic heating circuit for, at least during generation of the second alternating voltage, generating a first current through the first filament for heating the first filament and/or generating a second current through the second filament for heating the second filament; wherein the first current is an alternating current and that the second current is an alternating current; and wherein the driver circuit includes a first resonant circuit for generating the first and second alternating voltage and that the heating circuit includes a second resonant circuit for generating the first current and the second current.

2. The power circuit according to claim 1, wherein the power circuit includes a control circuit for controlling the driver circuit and/or the heating circuit.

3. The power circuit according to claim 2, wherein the control circuit is configured for regulating the magnitude of the first current and/or the magnitude of the second current in dependence upon the magnitude of the lamp current which runs between the first filament and the second filament as a result of the second alternating voltage.

4. The power circuit according to claim 3, wherein the control circuit is configured to increase the magnitude of the first current and/or the magnitude of the second current if the lamp current decreases and vice versa.

5. The power circuit according to claim 4, wherein the control circuit is configured for, when the magnitude of the lamp current is within a predetermined interval, increasing the magnitude of the first current and/or the magnitude of the second current if the lamp current decreases and vice versa, while the magnitude of the first current and the magnitude of the second current becomes zero when the lamp current becomes greater than a predetermined value, while an upper limit of the interval is smaller than or equal to the predetermined value.

6. The power circuit according to claim 5, wherein the control circuit is configured such that a lower limit of the interval is zero or that the control circuit is configured such that the lower limit of the interval becomes smaller when a dimming of the lamp increases and vice versa.

7. The power circuit according to claim 1, wherein the driver circuit is configured to enable dimming of the lamp.

8. The power circuit according to claim 1, wherein the power circuit is configured such that the first current and/or the second current can also be generated for preheating of the lamp when the lamp is not burning yet and the first and second alternating voltage are not generated yet.

9. The power circuit according to claim 1, wherein a first output terminal of the first resonant circuit is connected to connecting terminals of the first filament and that a second output terminal of the first resonant circuit is connected to connecting terminals of the second filament and/or that a first output terminal of the second resonant circuit and a second output terminal of the second resonant circuit are respectively connected to a first connecting terminal of the first filament and a second connecting terminal of the first filament and/or that the first output terminal of the second resonant circuit and the second output terminal of the second resonant circuit are respectively connected to a first connecting terminal of the second filament and a second connecting terminal of the second filament.

10. The power circuit according to claim 9, wherein the output terminals of the second resonant circuit are respectively connected to the output terminals of the heating circuit and/or that the output terminals of the heating circuit are formed by the output terminals of the second resonant circuit.

11. The power circuit according to claim 9, wherein the output terminals of the first resonant circuit are respectively connected to the output terminals of the driver circuit.

12. The power circuit according to claim 9, wherein the driver circuit includes a first circuit for generating an alternating voltage, a transformer, and the first resonant circuit to which the generated alternating voltage is supplied via the transformer for generating with the first resonant circuit the second alternating voltage and possibly the first alternating voltage.

13. The power circuit according to claim 12, wherein the direct voltage generated with the AC/DC converter is supplied to the first circuit and the second circuit, respectively.

14. The power circuit according to claim 9, wherein the heating circuit includes a second circuit for generating an alternating voltage, whereby the generated alternating voltage is supplied to the second resonant circuit for generating with the second resonant circuit the first current and/or the second current.

15. The power circuit according to claim 1, wherein the power circuit includes an AC/DC converter for generating a direct voltage which is supplied to input terminals of the driver circuit and the heating circuit, respectively.

16. The power circuit according to claim 1, wherein the lamp is a UV gas discharge lamp.

17. A system including a power circuit according to claim 1 and at least one gas discharge lamp which is connected to the power circuit.

18. The system according to claim 17, wherein the at least one gas discharge lamp is a UV gas discharge lamp.

19. The system according to claim 18, wherein the system is configured for disinfecting water with UV light and for this purpose further includes a watertight housing in which the lamp is contained.

20. A power circuit for at least one gas discharge lamp comprising a first filament and a second filament, the power circuit including an electronic driver circuit, for generating a first alternating voltage between the first and second filament for starting up the gas discharge lamp and for generating a second alternating voltage between the first and second filament for having the gas discharge lamp burn after it has been started up, wherein the power circuit further includes an electronic heating circuit for, at least during generation of the second alternating voltage, generating a first current through the first filament for heating the first filament and/or generating a second current through the second filament for heating the second filament; wherein the control circuit is configured for, when the magnitude of the lamp current is within a predetermined interval, increasing the magnitude of the first current and/or the magnitude of the second current if the current decreases and vice versa, while the magnitude of the first current and the magnitude of the second current becomes zero when the lamp current becomes greater than a predetermined value, while an upper limit of the interval is smaller than or equal to the predetermined value; wherein the control circuit is configured such that an upper limit of the interval becomes smaller when a dimming of the lamp increases and vice versa, while the upper limit is smaller than or equal to the predetermined value.

21. A power circuit for at least one a discharge lamp comprising a first filament and a second filament, the power circuit including an electronic drive circuit, for generating a first alternating voltage between the first and second filament for starting up the gas discharge lamp and for generating a second alternating voltage between the first and second filament for having the gas discharge lamp burn after it has been started up, wherein the power circuit further includes an electronic heating circuit for, at least during generation of the second alternating voltage, generating a first current through the first filament for heating the first filament and/or generating a second current through the second filament for heating the second filament; wherein the first current is an alternating current and that the second current is an alternating current.

22. The power circuit according to claim 21, wherein after the lamp is ignited the frequency of the second voltage is higher than the frequency of the first current and that after the lamp is ignited the frequency of the second voltage is higher than the frequency of the second current.

23. The power circuit according to claim 21, wherein a first output terminal of the heating circuit is connected to a first end of the primary side of a first transformer, a second output terminal for the heating circuit is connected to a second end of the primary side of a second transformer, a second end of the primary side of the first transformer is connected to a first end of the primary side of the second transformer, a first and second end of a secondary side of the first transformer are respectively connected to the first and second connecting terminal of the first filament, and a first and second end of the secondary side of the second transformer are respectively connected to the first and second connecting terminal of the second filament.

24. The power circuit according to claim 23, wherein a first output terminal of the driver circuit is connected via a first resistance to a first terminal of a direct voltage source, the first output terminal of the driver circuit is connected via a second resistance to a second terminal of the direct voltage source or to ground, a second output terminal of the driver circuit is connected via a third resistance to the first terminal of the direct voltage source, the second output terminal of the driver circuit is connected via a fourth resistance to the second terminal of the direct voltage source or to ground, wherein the first output terminal of the driver circuit is connected via a first voltage divider to the second terminal of the direct voltage source or to ground, and the second output terminal of the driver circuit is connected via a second voltage divider to the second terminal of the direct voltage source or to ground for measuring the voltage between the first voltage divider and the second voltage divider for being able to calculate from the measuring results of this measurement a leakage current from the lamp to ground and/or for being able to calculate from the measuring results of this measurement a direct voltage across the lamp and/or for determining from the measuring results if there is a leakage current path between the first and second output terminal of the driver circuit, which last can be measured by operation of an electronic switch by a control.

25. A power circuit for at least one gas discharge lamp comprising a first filament and a second filament, the power circuit including an electronic driver circuit, for generating a first alternating voltage between the first and second filament for starting up the gas discharge lamp and for generating a second alternating voltage between the first and second filament for having the gas discharge lamp burn after it has been started up, wherein the power circuit further includes an electronic heating circuit for, at least during generation of the second alternating voltage, generating a first current through the first filament for heating the first filament and/or generating a second current through the second filament for heating the second filament; wherein the driver circuit includes a first circuit for generating an alternating voltage, a transformer, and a first resonant circuit to which the generated alternating voltage is supplied via the transformer for generating with the first resonant circuit the second alternating voltage and possibly the first alternating voltage.

26. A power circuit for at least one gas discharge lamp comprising a first filament and a second filament, the power circuit including an electronic driver circuit, for generating a first alternating voltage between the first and second filament for starting up the gas discharge lamp and for generating a second alternating voltage between the first and second filament for having the gas discharge lamp burn after it has been started up, wherein the power circuit further includes an electronic heating circuit for, at least during generation of the second alternating voltage, generating a first current through the first filament for heating the first filament and/or generating a second current through the second filament for heating the second filament; wherein the power circuit includes control circuit for controlling the driver circuit and/or the heating circuit; wherein the control circuit is configured to carry out a first test wherein the driver circuit is activated while the heating circuit is deactivated and wherein a third alternating voltage generated by the control circuit is so low that in case of a broken or short-circuited lamp the driver circuit cannot get broken as a result of the broken or short-circuited lamp or wiring and wherein the control circuit is configured for carrying out the first test to measure the third voltage or a voltage related thereto and the lamp current or a current related thereto.

27. The power circuit according to claim 26, wherein on the basis of the measuring results it is determined if and how the lamp can be switched on safely.

28. A power circuit for at least one gas discharge lamp comprising a first filament and a second filament, the power circuit including an electronic driver circuit, for generating a first alternating voltage between the first and second filament for starting up the gas discharge lamp and for generating a second alternating voltage between the first and second filament for having the gas discharge lamp burn after it has been started up, wherein the power circuit further includes an electronic heating circuit for, at least during generation of the second alternating voltage, generating a first current though the first filament for heating the first filament and/or generating a second current through the second filament for heating the second filament; wherein the power circuit includes a control circuit for controlling the driver circuit and/or the heating circuit; wherein the control circuit is configured to carry out a second test wherein the driver circuit is deactivated while the heating circuit is activated and wherein the generated first current and/or the generated second current are each so low that in case of a broken or short-circuited lamp or wiring the heating circuit cannot get broken as a result of the broken or short-circuited lamp or wiring and wherein the control circuit is configured for carrying out the second test to measure the first current or a current related thereto, the second current or a current related thereto, a voltage on output terminals of the heating circuit or a voltage related thereto.

* * * * *